US006290006B1

(12) United States Patent
Crawford

(10) Patent No.: US 6,290,006 B1
(45) Date of Patent: Sep. 18, 2001

(54) APPARATUS AND METHOD FOR A ROLLER BIT USING COLLIMATED JETS SWEEPING SEPARATE BOTTOM-HOLE TRACKS

(75) Inventor: Micheal B. Crawford, Duncanville, TX (US)

(73) Assignee: Halliburton Engrey Service Inc., Carrollton, TX (US)

( * ) Notice: Subject to any disclaimer, the term of this patent is extended or adjusted under 35 U.S.C. 154(b) by 0 days.

(21) Appl. No.: 09/406,250

(22) Filed: Sep. 27, 1999

Related U.S. Application Data

(60) Provisional application No. 60/102,286, filed on Sep. 29, 1998.

(51) Int. Cl.[7] ..... E21B 10/18
(52) U.S. Cl. ..... 175/339; 175/393
(58) Field of Search ..... 175/339, 340, 175/393, 424

(56) References Cited

U.S. PATENT DOCUMENTS

| | | | | |
|---|---|---|---|---|
| 4,106,577 | * | 8/1978 | Summers | 175/340 |
| 4,369,849 | | 1/1983 | Parrish | 175/340 |
| 4,546,837 | | 10/1985 | Childers et al. | 175/340 |
| 4,582,149 | | 4/1986 | Slaughter, Jr. | 175/340 |
| 4,665,999 | * | 5/1987 | Shoemaker | 175/340 |
| 4,794,995 | | 1/1989 | Matson et al. | 175/393 |
| 5,199,516 | | 4/1993 | Fernandez . | |
| 5,439,067 | | 8/1995 | Huffstutler | 175/339 |
| 5,462,128 | | 10/1995 | Gray | 175/339 |
| 5,755,297 | | 5/1998 | Young et al. | 175/331 |
| 5,894,897 | * | 4/1999 | Vail | 175/318 |

FOREIGN PATENT DOCUMENTS

| | | |
|---|---|---|
| 0 449 416 A2 | 10/1991 | (EP) . |
| 0 452 584 A1 | 10/1991 | (EP) . |
| 0 737 797 A2 | 4/1995 | (EP) . |

* cited by examiner

*Primary Examiner*—David Bagnell
*Assistant Examiner*—Jennifer Dougherty
(74) *Attorney, Agent, or Firm*—Groover & Associates; Robert Groover; Betty Formby

(57) ABSTRACT

A roller cone jet-type drill bit with nozzles which direct collimated streams of mud at different angles, to sweep different radii of the hole bottom.

29 Claims, 9 Drawing Sheets

APPARATUS AND METHOD FOR A ROLLER BIT USING COLLIMATED JETS SWEEPING SEPARATE BOTTOM-HOLE TRACKS

CROSS-REFERENCE TO OTHER APPLICATION

This application claims priority from provisional application 60/102,286 filed Sep. 29 1998, which is hereby incorporated by reference.

BACKGROUND AND SUMMARY OF THE INVENTION

The present invention relates to rotary drilling, and particularly to flow optimization of jet bits during rotary drilling.

Background: Rotary Drilling

Oil wells and gas wells are drilled by a process of rotary drilling, using a drill rig such as is shown in FIG. 1. In conventional vertical drilling, a drill bit 10 is mounted on the end of a drill string 12 (drill pipe plus drill collars), which may be miles long, while at the surface a rotary drive (not shown) turns the drill string, including the bit at the bottom of the hole.

Two main types of drill bits are in use, one being the roller cone bit, an example of which is seen in FIG. 2. In this bit a set of cones 16 (two are visible) having teeth or cutting inserts 18 are arranged on rugged bearings such that when rotated about their separate axes, they will effectively cut through various rock formations. The second type of drill bit is a drag bit, having no moving parts, seen in FIG. 3.

Drag bits are becoming increasingly popular for drilling soft and medium formations, but roller cone bits are still very popular, especially for drilling medium and medium-hard rock. There are various types of roller cone bits. One type, insert bits, are normally used for drilling harder formations, and have teeth of tungsten carbide or some other hard material mounted on their cones. As the drill string rotates, the cones roll along the bottom of the hole and the individual hard teeth will induce compressive failure in the formation.

One of the key requirements in drilling is to remove the fractured material from the hole bottom. That is, the formation material to be removed must be 1) fractured, 2) entrained in the flow of drilling fluid, and 3) swept uphole. The function of entraining the fractured material in the flow of drilling fluid is an essential part of this material transport process, especially with roller cone bits. If the fractured material is not efficiently removed from the cutting face, then the impingement of the bit teeth into the intact formation at each pass may be reduced, and energy (and tooth life) may be wasted on further crushing formation material which has already been detached.

Normally a high flow of drilling fluid (typically drilling "mud") is pumped through the drill string to nozzles in the drill bit. Originally, mud was directed at the rotating roller cones, with the purpose of cleaning the cones. With the use of jet bits, in which velocities of hundreds of feet per second are common, the nozzles are normally directed toward the hole bottom. The mud is pumped at high pressures and high flow rates, so that the fluid flow at the hole bottom is very turbulent. The powerful and turbulent flow of mud at the hole bottom helps to separate cuttings from the face, and also cleans the bit and carries away entrained cuttings.

No matter how turbulent the fluid environment is, there will still be a stagnant boundary layer at any solid surface. (This boundary layer becomes thinner at high turbulence, but is always present.) The presence of high-velocity turbulent flows helps to get the cuttings out of the stagnant boundary layer at the hole bottom, but this stage of transport is still an important limit on efficiency.

The roller cone bits which are used in softer formations may have a significant offset angle in their geometries, i.e. the cone axes do not intersect the borehole axis. The geometry of this offset angle makes the teeth scrape across the hole bottom as the bit rotates. (That is, the cones do not roll perfectly, but are always forced to skid at an angle.) This scraping action helps clear cuttings from the hole bottom. Drilling in soft formations tends to produce a much higher volume of cuttings.

During drilling operations, mud is pumped down through the drill string and out nozzles 28 in the drill bit 10, at high pressures and high flow rates. The flow of the mud is one of the most important factors in the operation of the drill bit, serving to remove the cuttings, to cool the drill bit and teeth, and to wash away accumulations of soft material which can clog the bit. Drilling mud also serves to stabilize the borehole and balance the hydrostatic pressure of the formation at the hole bottom. Where these functions are less critical, air, mist, water or other fluids are sometimes used instead of mud.

Background: Nozzles

Within the aperture where mud leaves the bit, removable wear-resistant nozzles determine the size of the opening, and therefore the final velocity of the mud stream. An example can be seen in FIG. 4. In this figure, a nozzle 20 has been inserted into the aperture 14, where it fits snugly. It can be held in place by any one of several means, such as a snap ring 22 (often shrouded to protect the ring from erosion from the mud), screw threads, or a nail lock (where a flexible "nail" is inserted from the edge of the bit to fit into a groove on the outside of the nozzle and inside of the aperture, locking the nozzle in place). At the inside end of the nozzle, its inside diameter is approximately that of the opening above it, while at its outside end, the diameter can be whatever is desired to give the final flow characteristics. To adjust the flow, the nozzle can be replaced with another nozzle which has a different internal diameter at the outside end.

Background: Collimated Flows

In this application, "collimated" refers to fluid streams which contain as little transverse velocity as possible, within the normal constraints of a jet bit. Collimated streams are normally achieved by using a straight nozzle at the end of (and aligned with) a straight passageway which is straight for at least several times the inside diameter of the nozzle. Some drill bit designs use mud flow patterns which are intentionally decollimated. The nozzles eject streams of drilling fluid at high velocities, but they are being injected into a volume of very turbulent flow. Since the velocity of the fluid inside the nozzle is very high, the fluid inside the nozzle is also in a turbulent flow regime. However, it is possible to minimize the lateral components of flow (as is well known), to produce a stream which has as little divergence as possible. This is normally done, in a jet bit, by using a straight nozzle at the end of a straight fluid course which has a central axis aligned with the central axis of the nozzle. FIG. 12 shows a fluid course and nozzle with their axes aligned. The fluid course axis 1204 is identical to the nozzle axis 1202.

Turbulent fluid streams exiting a nozzle diverge as they entrain the surrounding fluid in the hole bottom. The maximum velocity is at the axis of the jet. This axis also defines the stagnation point, the place on the hole bottom where the pressure is at a maximum. The pressure decreases radially from the stagnation point. For detailed analysis of jet impact studies that use this kind of modeling, see, for example, *The Effect of Nozzle Diameter on Jet Impact for a Tricone Bit* by Warren and Winters, SPE-AIME. FIG. 13 shows how the pressure beneath the nozzle decreases radially from the axis of the nozzle.

Roller Bit with Collimated Jets Sweeping Separate Bottom-Hole Tracks

The present application discloses jet-type roller cone drilling with nozzles which direct collimated streams of mud at different angles, to sweep different radii of the hole bottom. As the bit rotates, each collimated fluid stream attacks a different track along the hole bottom. This provides more efficient removal of cuttings and a higher net rate of penetration.

When the collimated stream exits the nozzle, it immediately begins to diverge. If the cutting face were not close to the nozzle, such a stream would simply mix into the chaotic overall velocity field of the turbulent flow volume below the bit body. The length before the stream dissipates depends on factors such as the nozzle width, the stream velocity, and the relative densities of the stream and of the turbulent flow volume. The present invention teaches that the nozzles should be positioned so that the stream does impact the cutting face. Quantitatively, this can be defined in terms of the peak pressure where the axis of the nozzle points at the cutting face. The present invention teaches that the pressure where the axis of the nozzle intersects the stagnant boundary layer at the cutting face should be at least half of the total pressure inside the nozzle (and ideally equal to or slightly less than the total pressure inside the nozzle).

Thus a collimated stream causes a localized pressure maximum where it hits the cutting face. This localized pressure maximum means that there will be a strong lateral acceleration component at the cutting face (away from this localized pressure maximum, in every direction parallel to the cutting face). This means that the impact of the collimated stream on the cutting face will tend to detach fragments and particles which are partially adhered to the cutting face. Moreover, the high lateral fluid velocities around this local pressure maximum will tend to thin the stagnant boundary layer at the cutting face, so fewer particles can stay entirely within the stagnant boundary layer. Moreover, the high lateral velocities will help to entrain fragments which intersect the overall plane of the boundary layer. Thus this localized pressure maximum is a location of enhanced cuttings removal. The present application teaches that this enhanced cuttings removal effect is best exploited if the localized pressure maxima do not all follow the same track as the bit rotates.

The disclosed innovations, in various embodiments, provide one or more of at least the following advantages:

- the use of separate tracks permits highly collimated fluid streams to be used, resulting in better cleaning of the hole bottom;
- the use of separate tracks provides more extensive coverage of the hole bottom; and
- a higher net rate of penetration results.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation).

Figure 1:
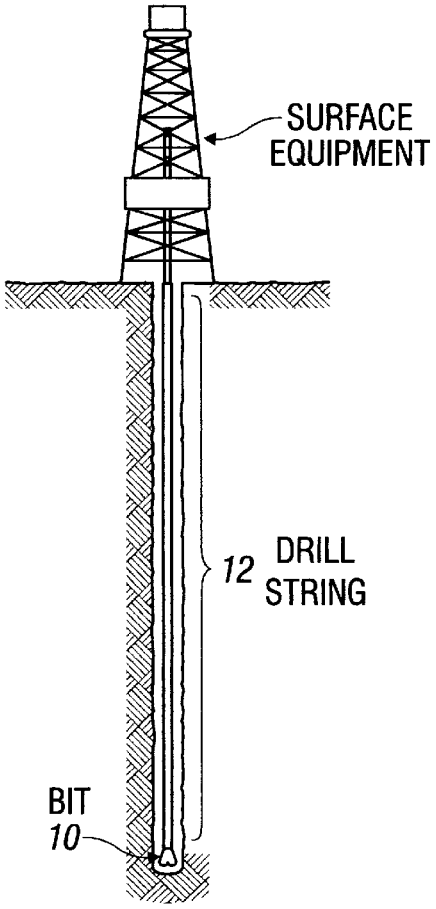
FIG. 1 (PRIOR ART)
FIG. 1 shows a drill rig, including surface equipment, drill string, and drill bit.
Figure 2:
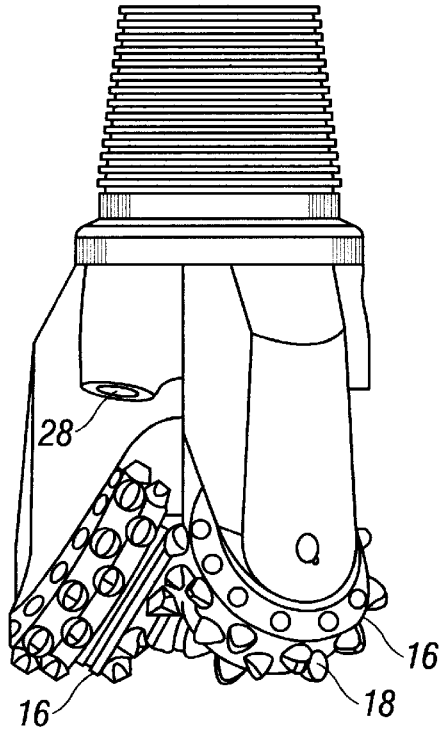
FIG. 2 (PRIOR ART)
FIG. 2 shows a roller-cone drill bit.
Figure 3:
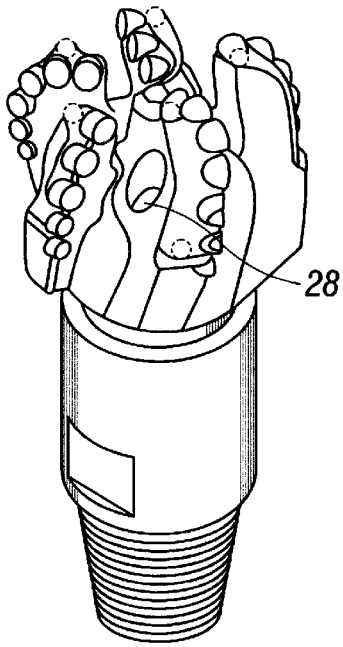
FIG. 3 (PRIOR ART)
FIG. 3 shows a drag bit.
Figure 4:
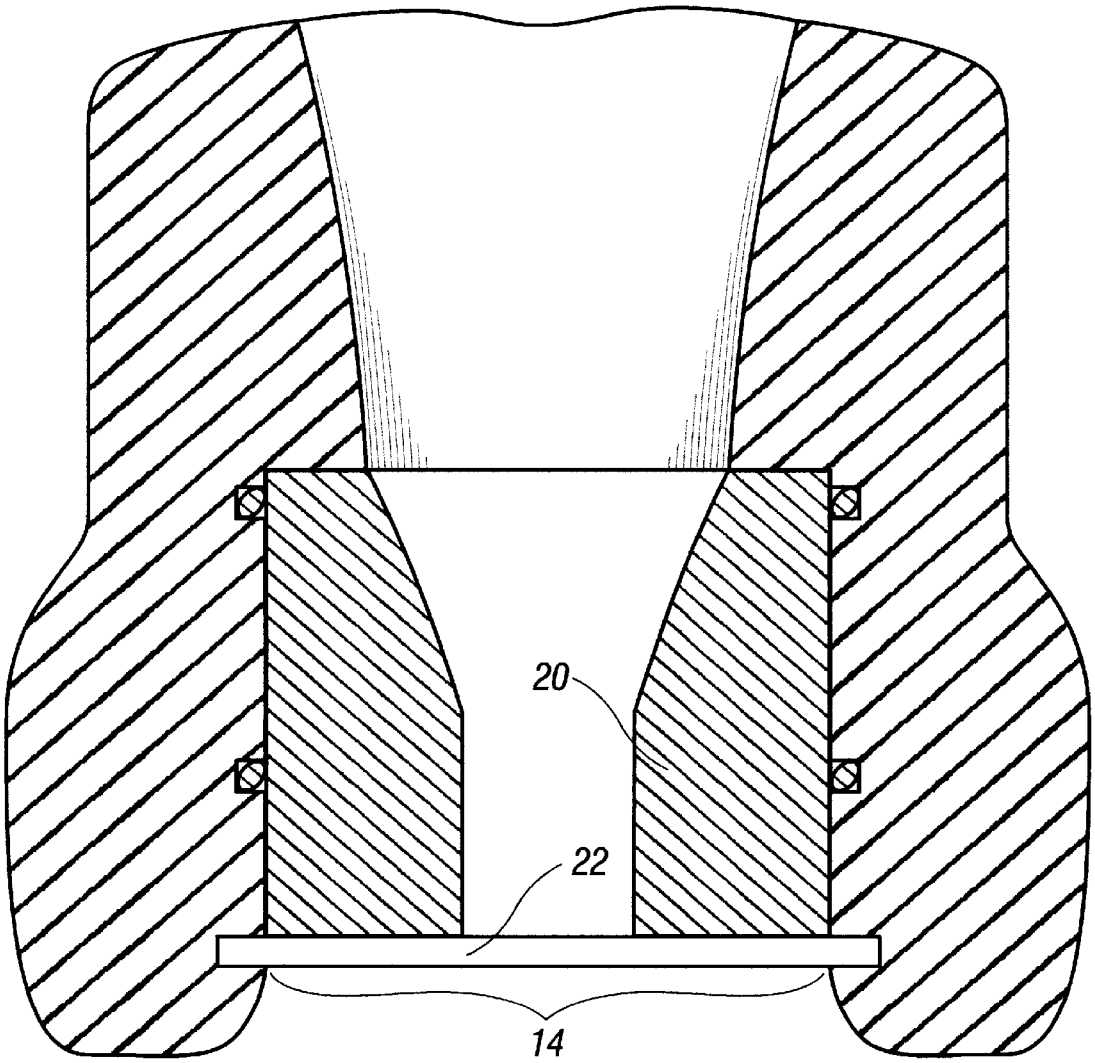
FIG. 4 (PRIOR ART)
FIG. 4 shows a nozzle attached to the end of a fluid course.
Figure 5:
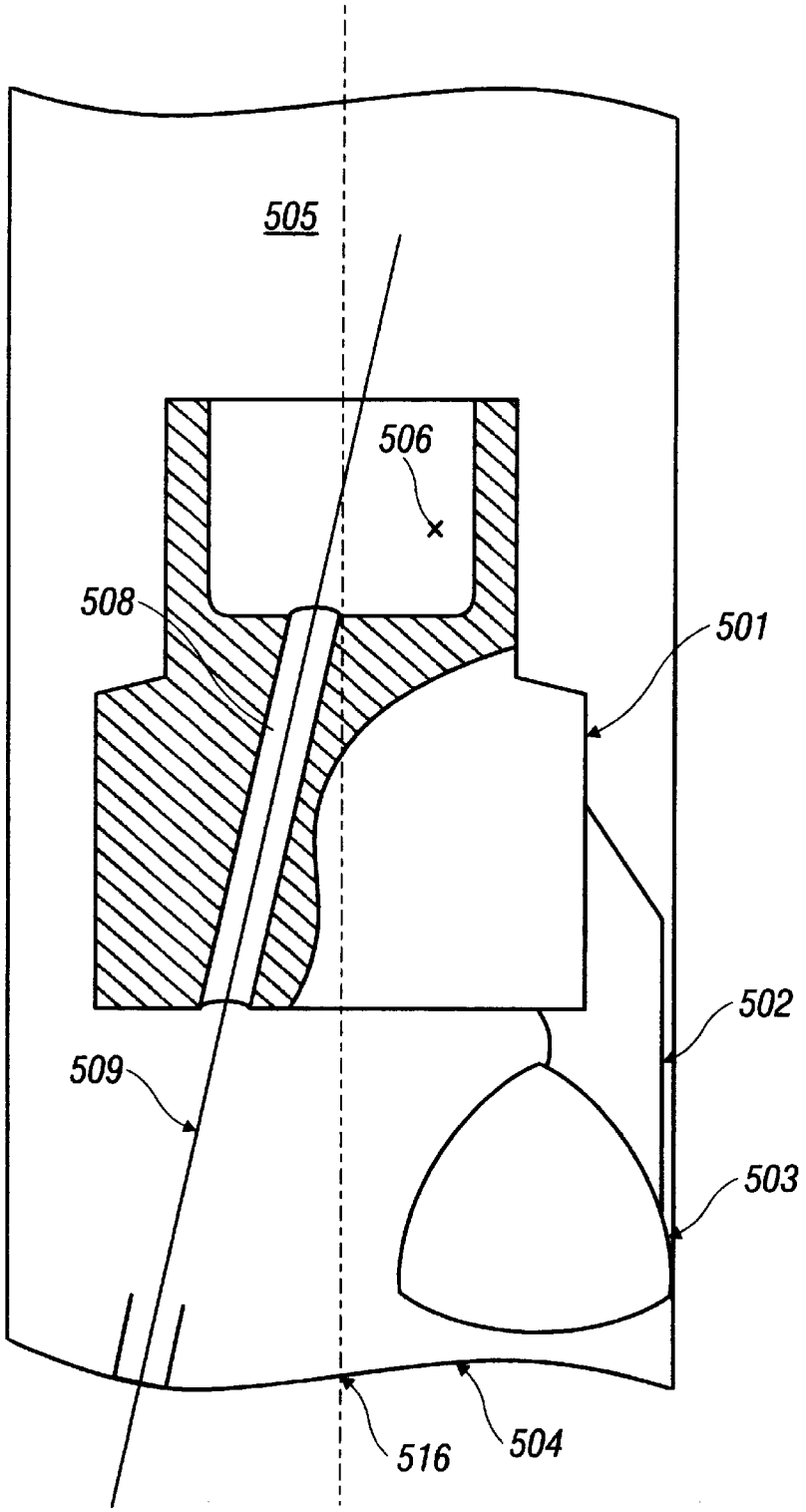
FIG. 5 (PRIOR ART)
FIG. 5 shows a conventional roller cone drill bit. A cross section shows one of the fluid courses and the drilling fluid cavity.

FIG. 5 shows a conventional drill bit, having a body 501 with a principal axis 505 and one or more legs 502 extending toward the drilling surface 504. The legs 502 have roller cones 503 attached which act as cutting devices. FIG. 5 shows a cross-sectional view of the body 501 exposing the cavity 506 from which fluid courses 508 extend to direct collimated streams of drilling fluid toward the drilling surface 504. The fluid course 508 has a long axis 509. The principal axis 505 projects onto the drilling surface 504 at the center 516 of the drilling surface 504.

Figure 6:
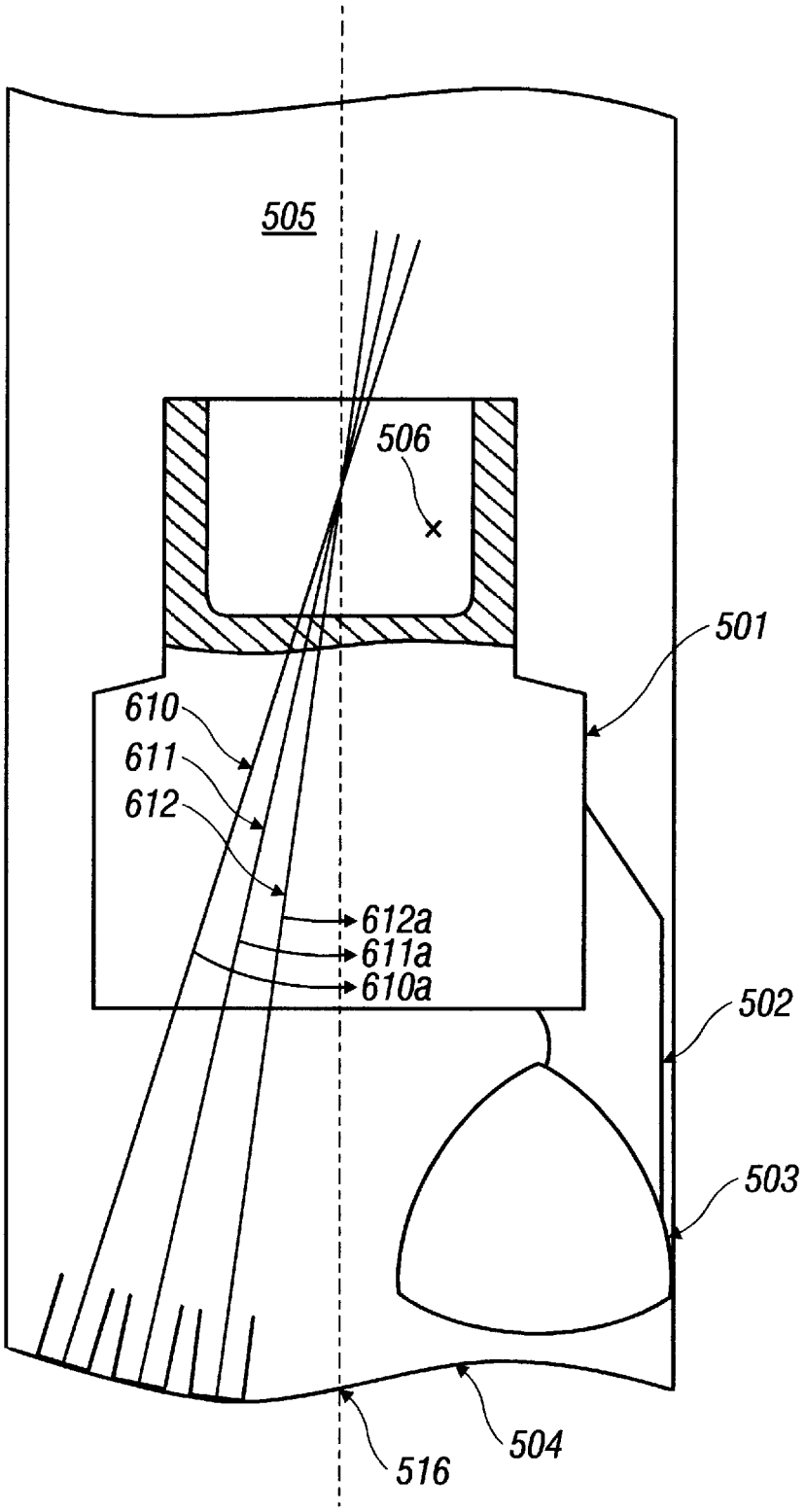
FIG. 6 shows a drill bit and shows the difference in the angles of the fluid courses. The three long axes of the fluid courses are shown as if they were in the same plane.

In the presently preferred embodiment, the fluid courses are designed so as to make different angles with the principal axis 505. In FIG. 6, a bit design with three fluid courses is shown. FIG. 6 also shows how the angles 610*a*, 611*a*, 612*a* of the long axes 610, 611, 612 of the three fluid courses differ. (This Figure is drawn to overlay the three long axes in a single drawing, but of course these are normally separated by approximately 120° around the bit's principal axis.) Note that the long axes 610, 611, 612 of the fluid courses project onto the drilling surface 504 at a different distance from the center 516 of the drilling surface 504 (which is aligned with the principal axis of the bit). (Note that the drilling surface is usually, as illustrated, not perfectly planar, and the cones themselves are not exactly conical.) The innermost fluid course axis 612 makes the smallest angle 612*a* with the principal axis 505 and directs fluid onto the drilling surface 504 closest to the center 516 of the drilling surface 504. The angle 612*a* the innermost fluid course 612 makes with the principal axis 505 is usually as small as possible, given the space limitations created by the roller cones 503. The outermost fluid course 610 makes the largest angle 610*a* with the principal axis 505 and is, in one embodiment, as large as possible given the limitation of the diameter of the body 501. The middle fluid course 611 aims at the space on the drilling surface 504 between the outermost and innermost fluid courses.

Figure 12:
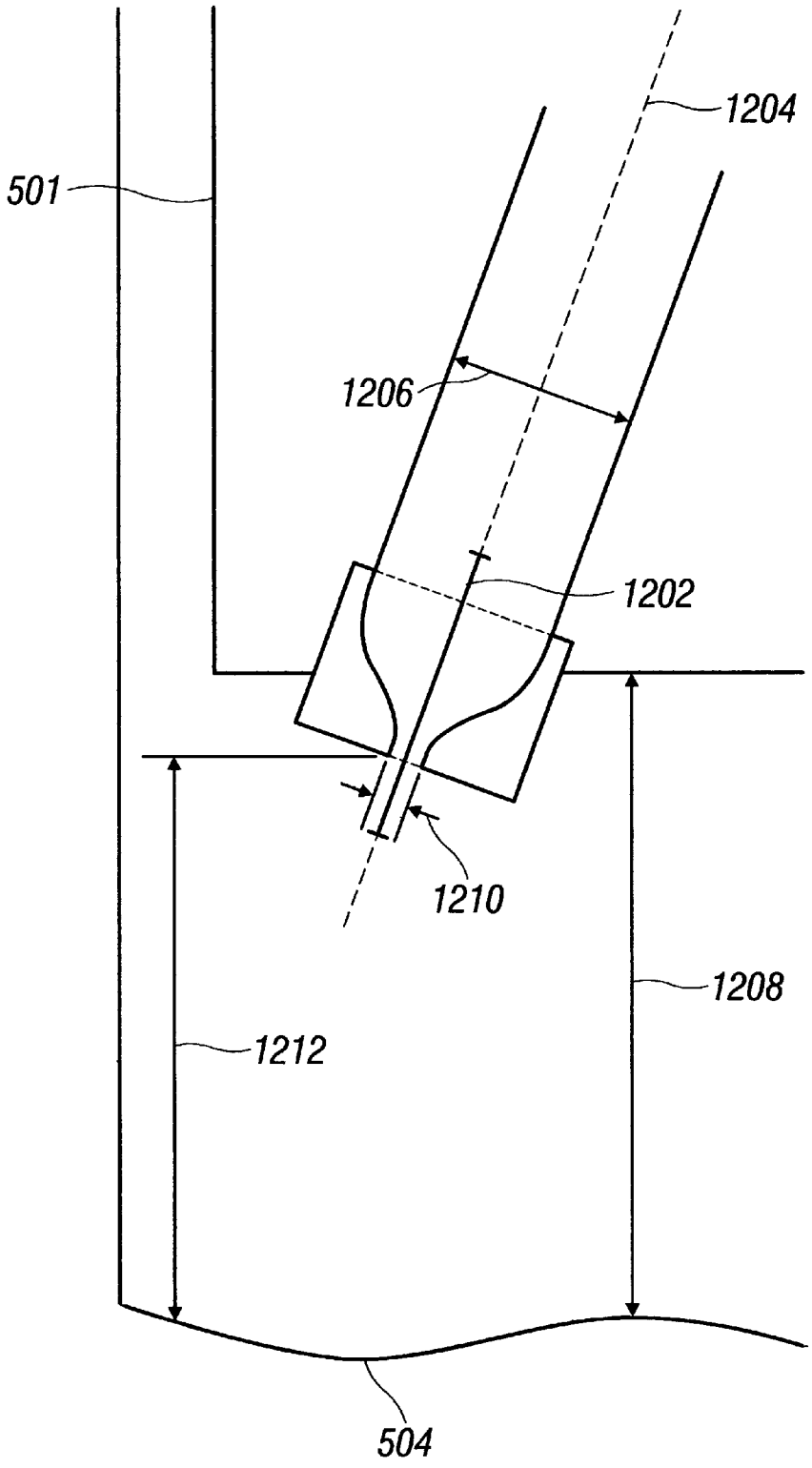
FIG. 12 shows a fluid course and its nozzles with their respective axes exactly aligned.

FIG. 12 shows the dimensions of a sample drill bit, including the fluid course diameter 1206, the distance 1208 from the bit body to the hole bottom 504, the distance 1212 from the nozzle to the hole bottom 504, and the nozzle opening diameter 1210.

In a sample embodiment, with a 12¼ inch drill bit, and drilled passages within the steel bit body of 1¼ inches in diameter, the distance from the lowest point on the nozzles to the bottom of the hole is 7 inches, and the long axes of the fluid courses exit the bottom of the drill bit body at radii of 3.078, 3.205, and 3.332 inches from the center of the bit body. In this example, the angles of the three fluid courses with respect to the principal axis of the bit body are 15, 16, and 17 degrees respectively. Given these dimensions, the fluid courses sweep hole bottom radii of 4.954, 5.212, and 5.472 inches, respectively.

Under the extremely turbulent and inhomogeneous fluid flow conditions at the drilling face, it is hard to measure precisely where the collimated high-velocity fluid streams become subsumed in the generally turbulent flow. Simulations of the fluid interactions in the hole show a relationship between the velocity and flow rate of the exiting fluid and the nozzle diameter. The stream velocity and distance to the hole bottom also help determine the effectiveness of the drilling mud.

As the distance between the nozzle opening and the hole floor increases, the general turbulence in the hole bottom has a greater effect on the collimated fluid flows. Thus it is most preferable to locate the nozzle outlet close enough to the cutting face that localized cleaning effects can still occur.

This positioning relationship affects the pressure created by the fluid streams on the hole bottom. In a sample embodiment, with a nozzle opening diameter (Amin) of 16/32" the simulation results show that peak stream velocity (Vmax) and differential pressure (DP) across the nozzle depend on the flow rate (Q). When the flow rate is 500 gallons per minute, Vmax is 850.35 feet per second. The differential pressure is 551.18 psi. Simulations show the following relationships:

Vmax=0.95 Q/Amin

DP=0.096 (total pressure at the nozzle inlet), where total pressure is static pressure+dynamic pressure.

Figure 13:
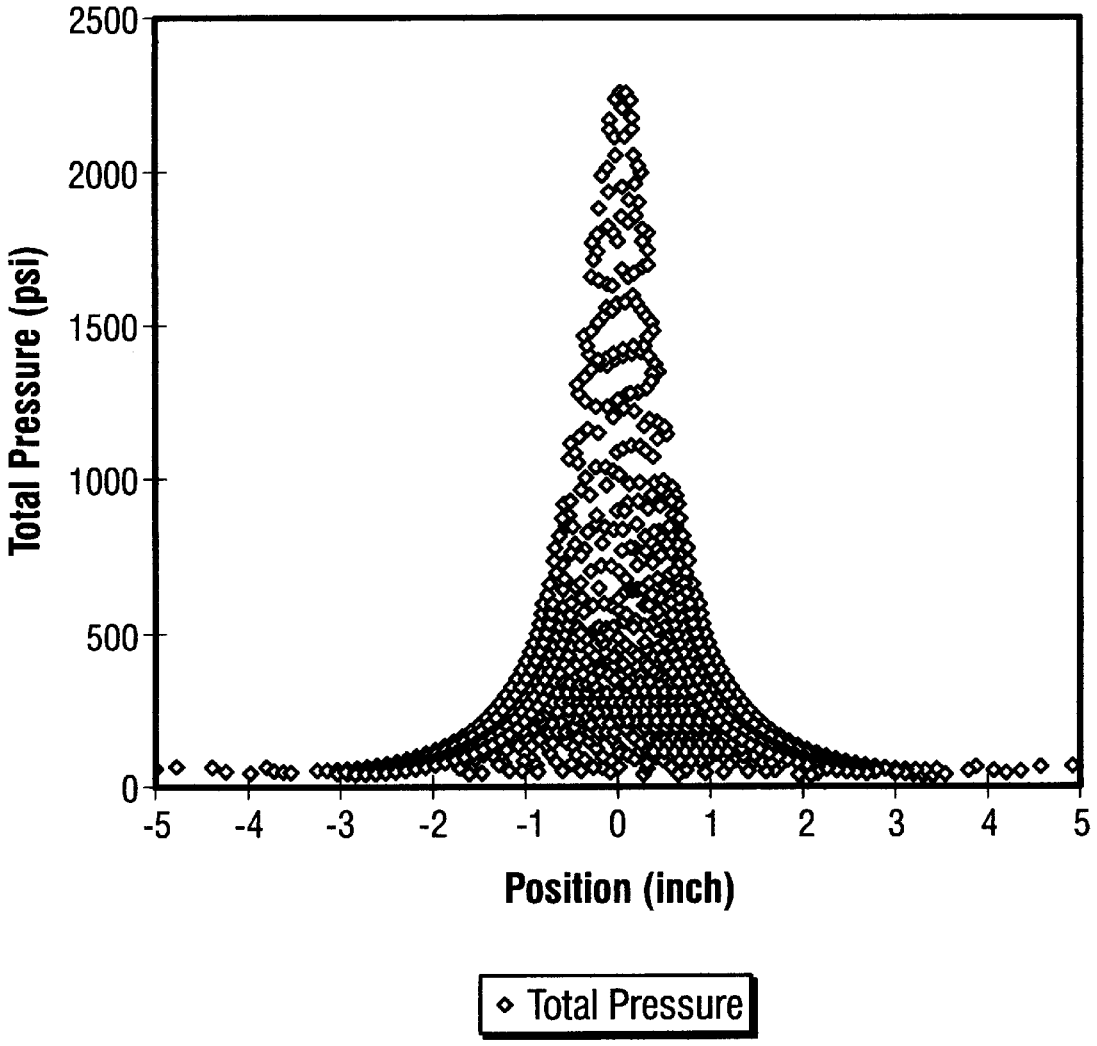
FIG. 13 shows the pressure below the nozzle, and how that pressure decreases radially perpendicular to the nozzle axis.

FIG. 13 shows the pressure below the nozzle, and how that pressure decreases radially perpendicular to the nozzle axis. The data for FIG. 13 was taken with the above mentioned parameters, at a surface five inches below the nozzle opening. The "zero" point on the x-axis is where the nozzle axis projects onto that surface.

There are many ways to describe the relationship between the nozzle opening and the hole floor. One means of describing this positioning relationship is to use ratios of various dimensions. For example, in the sample 12¼ inch diameter drill bit embodiment detailed above, the nozzle outlets are separated from the hole bottom by about 5.6 fluid course diameters (i.e., the ratio of 7 inches, the distance to the hole bottom, to 1.25, the fluid course diameter). This ratio is preferably less than 7, and more preferably less than 5.

Another way of assessing this positioning relationship is by the ratio of the vertical distance from the nozzle outlets to the hole bottom to the maximum nozzle diameter which can be used in that particular bit size. For example, in the sample 12¼ inch diameter drill bit embodiment detailed above, the nozzle outlets are vertically separated from the hole bottom by 7 inches, and the maximum nozzle diameter which can be used in the preferred 12.25" bit is 28/32", so this ratio is 8. This ratio is preferably less than 10, and more preferably less than 7.

Another way of assessing this positioning relationship is by the ratio of the vertical distance from the nozzle outlets to the hole bottom to the bore diameter. For example, in the sample 12¼ inch diameter drill bit embodiment detailed above, the nozzle outlets are vertically separated from the hole bottom by 7 inches, and this ratio is 0.571. This ratio is preferably less than 0.7, and more preferably less than 0.5.

Another way to describe this positioning relationship is by the ratio of the vertical distance from the nozzle outlets to the hole bottom to the actual nozzle diameter. For example, when the sample 12¼ inch diameter drill bit embodiment detailed above is used with a number 12 nozzle (i.e. 12/32", which is as small as would typically be used in the field for this size of bit), the nozzle outlets are vertically separated from the hole bottom by 7 inches, and the ratio is 18.7. This ratio is preferably less than 20, and more preferably less than 15.

Figure 7:
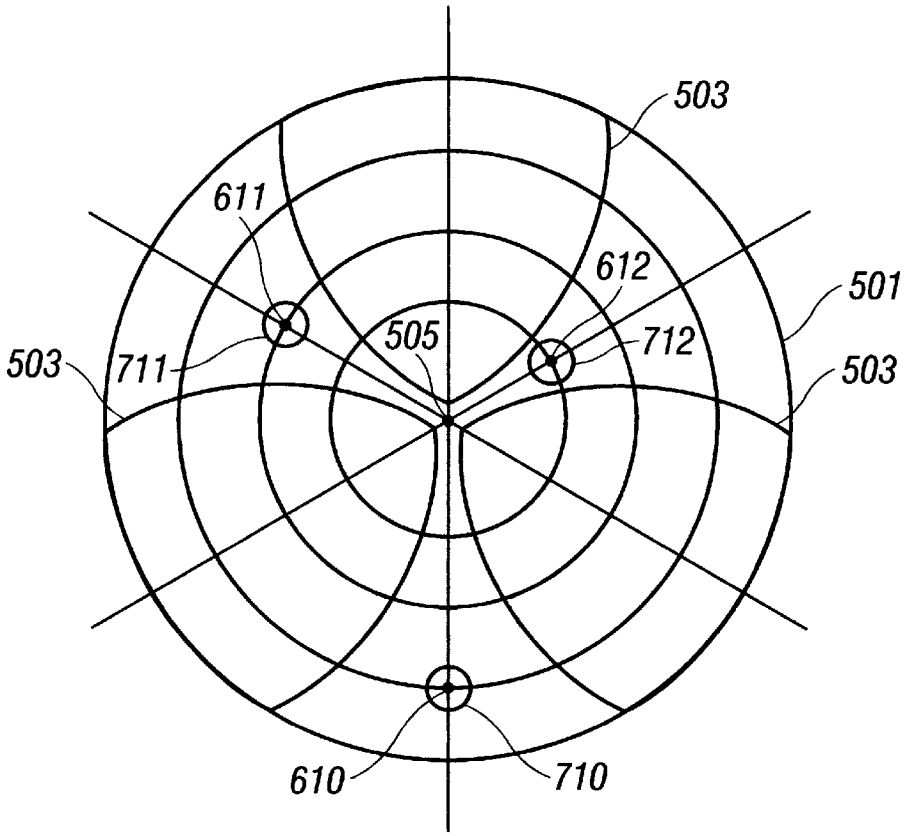
FIG. 7 shows a bottom view of a drill bit. The differing locations of the exit holes in respect to the principal axis are shown.

FIG. 7 shows a bottom view of the drill bit with the roller cones 503 and the exit holes for three fluid courses 710, 711, 712 and their respective long axes 610, 611, 612 seen endwise. In this example one fluid course exits between each pair of roller cones 503; only one ring of nozzles is present, and no center jet is used.

Figure 8:
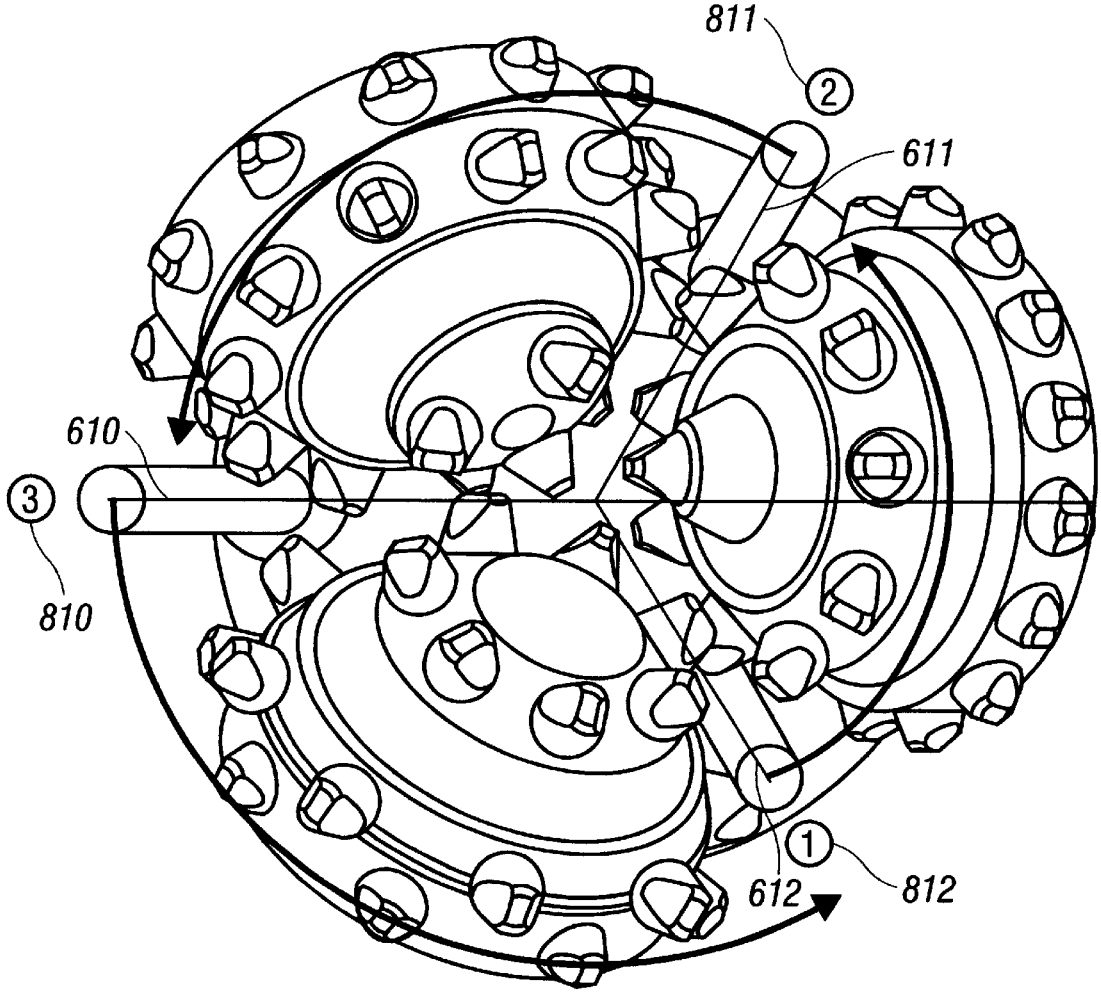
FIG. 8 shows a bottom view of a drill bit. The fluid courses are projected to show the different radii targeted on the drilling surface.

FIG. 8 shows the bottom view of the drill bit with the roller cones 503 and projections 810, 811, 812 of the fluid courses, showing the different radii at which fluid strikes the drilling surface 504 as measured from the center 516 of the drilling surface 504.

Figure 9:
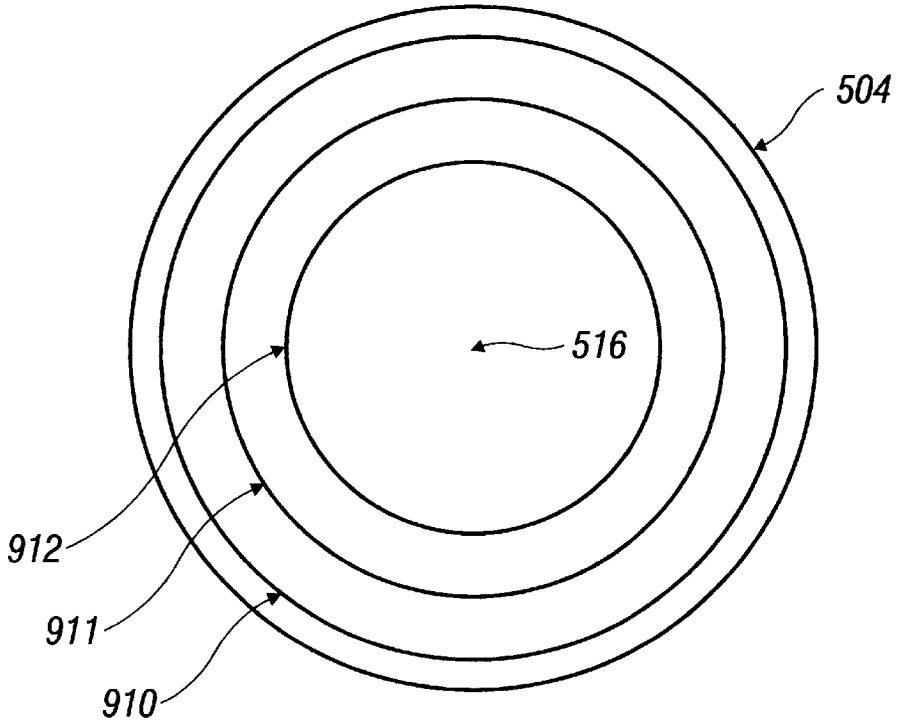
FIG. 9 shows the drilling surface. The concentric circles show the paths traced by the long axes of the fluid courses when projected onto the drilling surface.

FIG. 9 shows the drilling surface 504 with its center 516 and the concentric paths 910, 911, 912 traced by the long axes 610, 611, 612 of each fluid course as the drill bit rotates. By targeting different areas of the drilling surface with collimated streams of high velocity drilling fluid, the drilling surface is more efficiently cleaned, which improves the rate of penetration. Tests of various designs for roller cone bits with collimated jets sweeping different hole bottom tracks show changes in rate of penetration from −1% to +15% when compared to conventional drill bits. This is a very favorable result.

Alternative Embodiment: Multiple Rings of Fluid Courses

As the bit diameter increases, greater areas must be swept by the collimated fluid jets. Though the present invention alleviates this problem somewhat by targeting different areas of the hole bottom, under some circumstances multiple rings of differently-oriented collimated jets may be useful.

Figure 10:
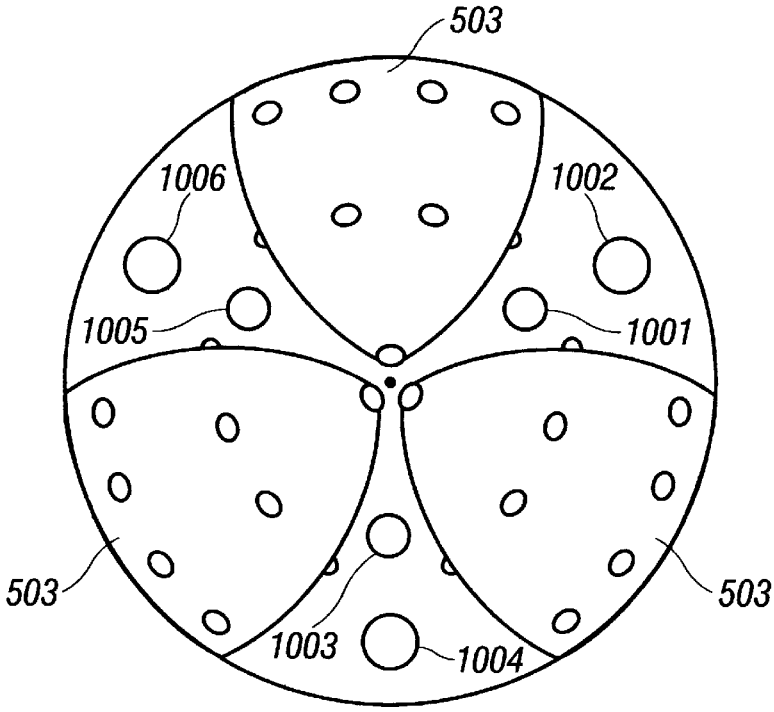
FIG. 10 shows an alternative embodiment of the invention. Two rings of fluid courses are drilled into the body of the drill bit, forming an inner ring and an outer ring of fluid courses.

In another class of alternative embodiments, multiple rings of fluid courses are drilled into the body of the drill bit. FIG. 10 shows a bottom view of a three cone drill bit that has two rings of fluid courses 1001, 1002, 1003, 1004, 1005, 1006. Each fluid course is drilled so that a different area of the drilling surface is targeted with drilling fluid. The present invention contemplates any drill bit wherein any of the fluid courses targets a different area of the drilling surface than the other fluid courses with collimated streams of drilling fluid, and is not limited to drill bits where the fluid courses all target different areas of the drilling surface.

Alternative Embodiment: Various Numbers of Roller Cones Useable

Figure 11:
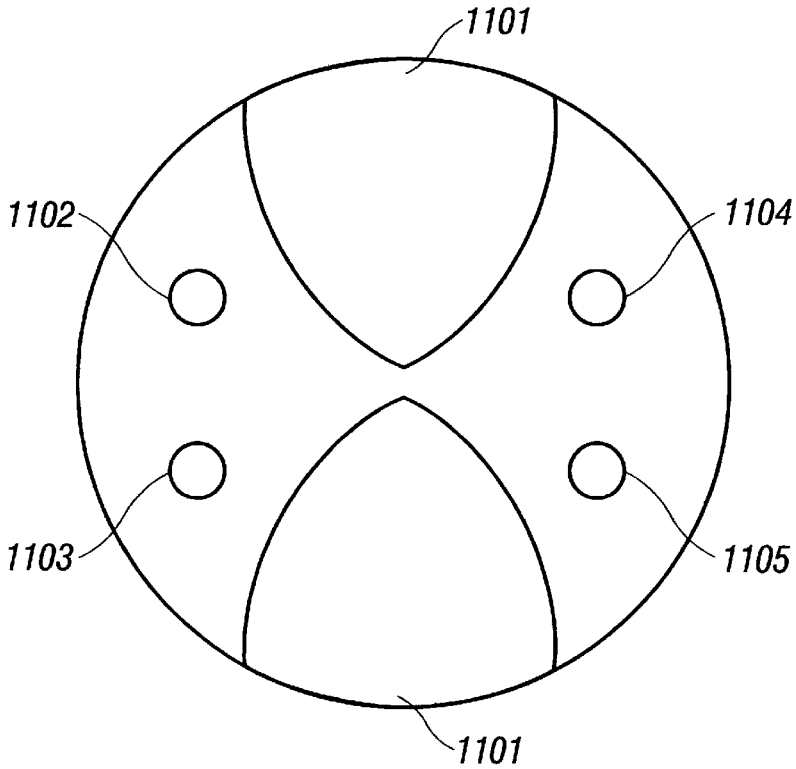
FIG. 11 shows a two cone alternative embodiment.

In an alternative embodiment, two roller cones are used as cutting devices instead of three, allowing more room for placement of the fluid courses. Any number of roller cones may be used. FIG. 11 shows a two cone 1101 bit with four fluid courses 1102, 1103, 1104, 1105.

Note that this bit includes two nozzles between each adjacent pair of cones.

Alternative Embodiment: Skew Nozzles

In another embodiment, the fluid courses may be skew in relation to the principal axis rather than co-planar. This invention contemplates drill bits with skew fluid courses that vary the radii at which they target the drilling surface with collimated streams of drilling fluid, said radii measured from the center of the drilling surface.

Definitions

Following are short definitions of the usual meanings of some of the technical terms which are used in the present application. (However, those of ordinary skill will recognize whether the context requires a different meaning.) Additional definitions can be found in the standard technical dictionaries and journals.

Jet bit: a drilling bit with replaceable nozzles that direct drilling fluid in a high velocity stream at the drilling surface.

Fluid course: the passage and nozzle within a drill bit that transports drilling fluid from the cavity toward the drilling surface.

Nozzle: a wear-resistant insert piece where a fluid course exits the drill bit body.

Stream: a high velocity column of drilling fluid ejected from the fluid course.

Rings (of nozzles): in the present application, this term is used to refer to the placement of one set of nozzles in a roller cone drill bit; one "ring" of nozzles refers to a set of nozzles which all have similar (but not necessarily identical) nonzero distances from the principal axis of the bit.

Drag bit: a drill bit with no moving parts. Such bits drill by intrusion and drag.

Mud: the liquid circulated through the wellbore during rotary drilling operations, also referred to as drilling fluid. Originally a suspension of earth solids (especially clays) in water, modern "mud" is a three-phase mixture of liquids, reactive solids, and inert solids.

Roller cone bit: a drilling bit made of two, three, or four cones, or cutters, that are mounted on extremely rugged bearings. Also called rock bits. The surface of each cone is made up of rows of steel teeth or rows of tungsten carbide inserts.

Collimated: in this application, collimated streams refer to fluid streams which contain as little transverse velocity as possible, within the normal constraints of a jet bit. Collimated streams are normally achieved by using a straight nozzle at the end of (and aligned with) a straight passageway which is straight for at least several times the inside diameter of the nozzle.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

In another embodiment, a center jet is added (i.e. an additional fluid course is drilled along the principal axis of the body). An angled center nozzle can optionally be used in combination with the differently angled nozzles described.

The innovative jet arrangements described can also be used in combination with other nozzles, e.g. which are less collimated, or which point uphole, or which are pointed at the sidewalls of the borehole.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

What is claimed is:

1. A drill bit comprising:

a body having a principal axis;

one or more cutting devices rotatably attached to the body;

a plurality of fluid courses, each of said fluid courses being connected to deliver drilling mud and each individually aligned to direct collimated fluid flows at respectively different angles from said principal axis.

2. The bit of claim 1, wherein said cutting devices are attached through a rotary joint to arms which are affixed to said body.

3. The bit of claim 1, wherein said fluid courses have respective center axes which are coplanar with said principal axis.

4. The bit of claim 1, comprising at least one other fluid course which is directed identically with one said course of said plurality of fluid courses.

5. The bit of claim 1, wherein said bit includes no fluid courses other than said plurality of fluid courses.

6. The bit of claim 1, wherein said fluid courses include nozzles affixed to said body.

7. The bit of claim 1, wherein said fluid courses include extended nozzles affixed to said body and extending outward from said body.

8. A drill bit comprising:

a body having a principal axis, and one or more cutting devices rotatably attached to cut into the bottom of a borehole as drilling progresses; and a plurality of fluid courses, said fluid courses being connected to deliver drilling mud and aligned to direct collimated fluid flows at respectively different radii on said bottom.

9. The bit of claim 8, wherein said cutting devices are attached through a rotary joint to arms which are affixed to said body.

10. The bit of claim 8, wherein said fluid courses have respective center axes which are coplanar with said principal axis.

11. The bit of claim 8, comprising at least one other fluid course which is directed identically with one said course of said plurality of fluid courses.

12. The bit of claim 8, wherein said bit includes no fluid courses other than said plurality of fluid courses.

13. The bit of claim 8, wherein said fluid courses include nozzles affixed to said body.

14. The bit of claim 8, wherein said fluid courses include extended nozzles affixed to said body and extending outward from said body.

15. A roller-cone drill bit comprising:

a body having a principal axis, said body having arms thereon and one or more cutting devices rotatably attached thereto, said cutting devices rolling on the bottom of a borehole, as said body is rotated under pressure and torque which is applied through a drill-string; and a plurality of fluid courses arranged in one or more rings, wherein at least two of said courses in at least one ring are aligned to direct collimated fluid flows at said bottom, at respectively different angles.

16. The bit of claim 15, wherein said fluid courses have respective center axes which are coplanar with said principal axis.

17. The bit of claim 15, wherein at least two of said fluid courses direct fluid to sweep different paths on said borehole hole bottom.

18. The bit of claim 15, wherein said bit includes no fluid courses other than said plurality of fluid courses.

19. The bit of claim 15, wherein said fluid courses include nozzles affixed to said body.

20. The bit of claim 15, wherein said fluid courses include extended nozzles affixed to said body and extending outward from said body.

21. A rotary drill bit, comprising:

a body having a principal axis;

one or more cutting devices rotatably mounted on said body;

a plurality of fluid courses within said body, said fluid courses being connected to deliver drilling mud, said fluid courses exiting said body at different radial distances from said principal axis, and said fluid courses directing collimated streams of drilling fluid at a hole bottom.

22. The drill bit of claim 21, wherein the fluid courses have long axes, and said long axes project onto the hole bottom at different radii, said radii measured from where said principal axis projects onto the hole bottom.

23. The drill bit of claim 21, wherein the fluid courses include nozzles opening in the direction of nozzle axes which are parallel and in line with said respective fluid course axes.

24. A rotary drill bit, comprising:

a body having a principal axis;

one or more cutting devices rotatably mounted on said body;

a plurality of fluid courses within said body, said fluid courses directing collimated streams of drilling fluid to a hole bottom, said fluid courses having long axes, said long axes all making the same angle with said principal axis, and said long axes projecting onto said hole bottom at different radii, said radii measured from where said principal axis projects onto said hole bottom to where said long axes project onto said hole bottom.

25. The drill bit of claim 24, wherein the fluid courses include nozzles opening in the direction of nozzle axes which are parallel and in line with said respective fluid course axes.

26. A method of designing a rotary drill bit which uses drilling mud, comprising the steps of:

optimizing a bit design with respect to multiple design parameters which include positioning of fluid courses within said bit so that collimated streams of drilling mud emitted therefrom sweep the hole bottom at different radii during drilling.

27. The method of claim 26, wherein the fluid courses have nozzles attached thereto which open in the direction of a nozzle axis, further comprising the step of:

aligning the fluid courses and nozzles such that the nozzle axis is parallel and in line with said fluid course long axis, allowing for the least possible divergence of exiting drilling fluid.

28. A method of drilling with a rotary drill bit which is designed to use drilling mud, said bit having a body, said body having a principal axis, one or more cutting devices rotatably attached to said body, a plurality of fluid courses within said body, said fluid courses each having long axes, comprising the steps of:

sweeping paths of different radii on a hole bottom with collimated streams of drilling mud, said radii measured from where the principal axis projects onto the hole bottom.

29. A rotary drilling system, comprising:

a drill string portion operatively connected to supply drilling mud to and to apply pressure and torque to a bit;

a mud pump connected to pump drilling mud through said drill string portion to said bit;

a rotary mechanism connected to apply torque through said drill string portion to said bit; and a retraction mechanism connected to controllably apply pressure through said drill string portion to said bit;

wherein said bit is a roller-cone bit, comprising:

a body having a principal axis;

one or more cutting devices rotatably attached to the body;

a plurality of fluid courses individually aligned to direct collimated fluid flows of drilling mud at respectively different angles from said principal axis.

* * * * *